US011181115B2

(12) United States Patent
Mei et al.

(10) Patent No.: US 11,181,115 B2
(45) Date of Patent: Nov. 23, 2021

(54) SUBSEA ASSEMBLY

(71) Applicant: Nuovo Pignone Tecnologie Srl, Florence (IT)

(72) Inventors: Luciano Mei, Florence (IT); Manuele Bigi, Florence (IT); Giacomo Ragni, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 364 days.

(21) Appl. No.: 15/743,031

(22) PCT Filed: Jul. 8, 2016

(86) PCT No.: PCT/EP2016/066278
§ 371 (c)(1),
(2) Date: Jan. 9, 2018

(87) PCT Pub. No.: WO2017/009229
PCT Pub. Date: Jan. 19, 2017

(65) Prior Publication Data

US 2019/0072096 A1 Mar. 7, 2019

(30) Foreign Application Priority Data

Jul. 10, 2015 (IT) ..... 102015000033012

(51) Int. Cl.
*F04D 13/08* (2006.01)
*F04D 25/06* (2006.01)
(Continued)

(52) U.S. Cl.
CPC ..... *F04D 25/0686* (2013.01); *E21B 36/001* (2013.01); *E21B 43/128* (2013.01);
(Continued)

(58) Field of Classification Search
CPC ..... F04D 25/0686; F04D 13/086; F04D 29/5806; F04D 13/08; E21B 36/001;
(Continued)

(56) References Cited

U.S. PATENT DOCUMENTS 1,702,565 A * 2/1929 Foster ..... F25B 39/02 165/169
3,251,401 A 5/1966 Gardner
(Continued)

FOREIGN PATENT DOCUMENTS

GB 2 457 784 A 9/2009
GB 2468920 A 9/2010
(Continued)

OTHER PUBLICATIONS

Search Report and Written Opinion issued in connection with corresponding IT Application No. 102015000033012 dated Feb. 29, 2016.

(Continued)

*Primary Examiner* — Bryan M Lettman
*Assistant Examiner* — Dnyanesh G Kasture
(74) *Attorney, Agent, or Firm* — Baker Hughes Patent Org.

(57) ABSTRACT

A subsea assembly comprising an electric subsea machine having an electric motor driving an operator, and a coolant circuit at least partially located in thermal contact with the electric motor, the coolant circuit including a cooling assembly located externally from the subsea machine, the cooling assembly comprising at least a heat transfer element, the subsea machine and the cooling assembly being supported by a common supporting frame; at least a part of the heat transfer element is integrated in the frame.

5 Claims, 3 Drawing Sheets

(51) Int. Cl.

| | |
|---|---|
| ***E21B 36/00*** | (2006.01) |
| ***F04D 29/58*** | (2006.01) |
| ***E21B 43/12*** | (2006.01) |
| ***F28D 1/047*** | (2006.01) |

(52) U.S. Cl.
CPC ..... *F04D 13/086* (2013.01); *F04D 29/5806* (2013.01); *F28D 1/0472* (2013.01)

(58) Field of Classification Search
CPC .... E21B 10/246; F28D 1/0472; F28D 1/0473; H02K 9/18; H02K 5/132; H02K 5/12; H02K 5/1285; H02K 9/00; H02K 9/22; H02K 5/18
See application file for complete search history.

(56) References Cited

U.S. PATENT DOCUMENTS 3,912,005 A * 10/1975 Griffiths ..... B23P 15/26 165/169
6,804,976 B1 * 10/2004 Dain ..... F25B 39/02 165/148
8,376,030 B2 * 2/2013 Jatkar ..... F24D 12/02 165/45
2008/0142203 A1 * 6/2008 Yanik ..... F28D 1/0417 165/151
2009/0314481 A1 * 12/2009 Poorte ..... F28D 1/022 165/184
2011/0211979 A1 * 9/2011 Schlenhoff ..... E21B 43/128 417/410.1
2011/0247788 A1 * 10/2011 Martinez ..... F04D 13/10 165/104.33
2012/0168142 A1 7/2012 Hernandez
2016/0258689 A1 * 9/2016 Evans ..... F28F 9/0137

FOREIGN PATENT DOCUMENTS

| | | | |
|---|---|---|---|
| WO | 2008/004885 | A1 | 1/2008 |
| WO | 2010/110676 | A2 | 9/2010 |
| WO | 2012/141599 | A1 | 10/2012 |
| WO | 2012/173985 | A2 | 12/2012 |

OTHER PUBLICATIONS

International Search Report and Written Opinion issued in connection with corresponding PCT Application No. PCT/EP2016/066278 dated Sep. 22, 2016.
International Preliminary Report on Patentability issued in connection with corresponding PCT Application No. PCT/EP2016/066278 dated Jan. 16, 2018.

* cited by examiner

SUBSEA ASSEMBLY

BACKGROUND OF THE INVENTION

Embodiments of the subject matter disclosed herein correspond to a subsea assembly, and in particular, to a subsea assembly comprising an electric subsea machine and a cooling assembly located externally to the subsea machine.

The subsea machine may be a compressor, a pump, a subsea electronic device, or any other subsea device requiring appropriate cooling.

In the field of "Oil & Gas", subsea machines are mainly used to increase the pressure of a fluid, which may be a gas mixed with a liquid, or to pump a fluid out form a submarine oil or gas deposit.

Subsea machines comprise a shaft, which may be vertically or horizontally supported by bearings; on the shaft, an electric motor and an operator are mounted. The operator may be a pressure rising assembly, for example a centrifugal compressor or a pump.

The subsea assembly may include a coolant circuit using process gas for cooling some parts of the machine, which may be the electric motor and/or bearings, high voltage connections and any other part requiring cooling. The coolant circuit may comprise a cooling assembly or heat exchanger that is separate, and located outside the subsea machine.

A main frame may be used to support the subsea machine during its transport to the seabed and during its operation. A secondary frame, fixed to the main frame, may support the cooling assembly. The cooling assembly may be fixed to the main frame on a side of the subsea machine.

The known configuration is space consuming in terms of footprint. The large footprint makes it difficult to handle the subsea assembly.

Moreover, the weight of the known configuration makes it difficult to position it on the seabed and to lift it from the seabed when maintenance or cleaning is necessary.

The current configuration does not allow an effective cleaning of the heat exchanger. In fact, the heat exchanger and its frame must be removed from the main frame for cleaning. This is costly and time consuming.

Moreover, the cooling efficiency of the heat exchanger may be reduced because of its position on one side of the subsea machine and because the configuration of pipes which are usually narrow, therefore with a reduced free convection coefficient.

BRIEF DESCRIPTION OF THE INVENTION

Therefore, there is a general need for an improved subsea assembly with a reduced footprint, lower weight and that may be easily maintained and cleaned as well as having a better heat exchanger efficiency.

An important idea relates to a cooling assembly having at least a heat transfer element integrated with the frame that supports the subsea machine.

Some embodiments of the subject matter disclosed herein correspond to a subsea assembly.

Additional embodiments of the subject matter disclosed herein correspond to a frame of a subsea assembly, having a heat transfer element integrated.

Embodiments of the subject matter disclosed herein correspond to a heat transfer element.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

Figure 1:
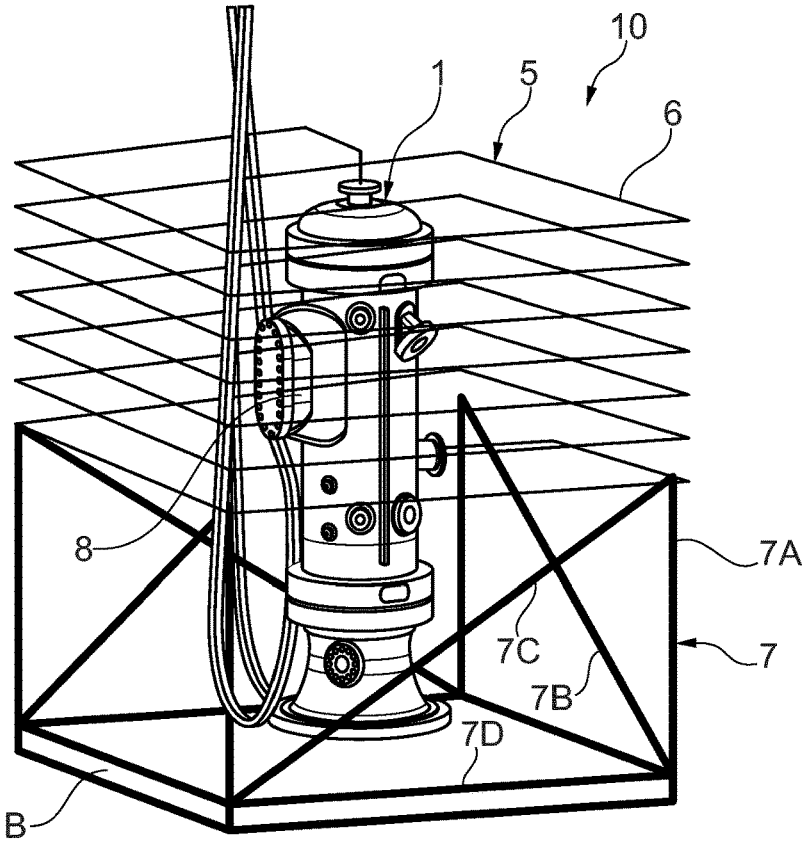
FIG. 1 is a simplified perspective view of a subsea assembly of the present disclosure.
Figure 3:
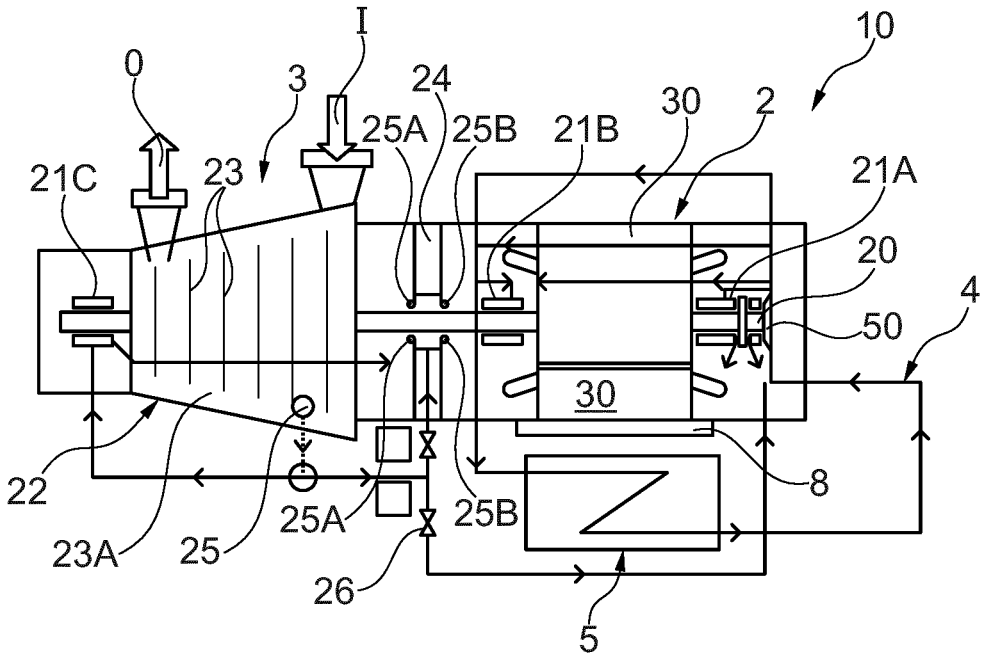
FIG. 3 is a schematic, simplified view, of a subsea compressor coupled with a cooling assembly.

FIG. 1, shows a subsea assembly 10 comprising an electric subsea machine 1. The electric subsea machine is schematically represented in FIG. 3, and may be a subsea motorcompressor or a subsea pump comprising in the same casing an electric motor and a compressor or pump.

An electric motor 2 may have a shaft 20 rotatably mounted on supporting bearings 21A, 21B, 21C. The shaft 20 may drive an operator 3 that may be a pump or a centrifugal compressor. In FIG. 3, the operator is a centrifugal compressor 22 having a plurality of impellers 23 mounted inside a stator 23A on the shaft 20. The shaft 20 may be formed in a single piece with the shaft of the motor, or it may be formed by a plurality of parts torsionally coupled.

The shaft 20 is completely housed inside the casing.

The centrifugal compressor includes an inlet I and an outlet O of the gas, which may be natural gas and may comprise liquid particles.

A wall 24 having first 25A and second 25B seals acting on the shaft 20, may separate that part of the subsea machine housing the electric motor, form that part of the subsea machine housing the operator 3. The first 25A and second seals 25B may face opposing sides of the wall 24.

A first bearing 21A of the motor may include a thrust bearing, while a second 21B and third 21C bearing may be radial.

Some subsea motor-compressor units usually employ oil-lubricated bearings for supporting the driving shaft others employ magnetic bearings, or active magnetic bearings; other integrated machines include hydrodynamic, hydrostatic or hybrid (hydrostatic/hydrodynamic) bearings, using a fluid, either liquid or gaseous, to generate a force radially or axially supporting the rotating shaft.

The centrifugal compressor may include a bleeding tap 25 connected to pipes for feeding the process gas in that part of the shaft comprised between the first 25A and second 25B seals, and to a third bearing 21C.

The bleeding tap may be further connected to that part of the subsea machine housing the electric motor, through a valve 26.

A coolant circuit 4 may be present, at least partially located in thermal contact with the electric motors or a part of it. The coolant circuit 4 may include pipes embedded in the coils 30 of the electric motors, or may include flow routes placed around and/or inside the coils 30.

The coolant circuit 4 may also include a part in thermal contact with a junction box 8 of the electric motor 2, in which high voltage connection may be located.

As shown in FIG. 3, the coolant circuit 4 may be in thermal contact also with a bearing 21A of the subsea machine 1. The coolant circuit 4 may comprise a coolant pump 50 torsionally fixed to the shaft 20 to circulate the coolant into the circuit.

The coolant circuit 4 also includes a cooling assembly 5 (also referred as heat exchanger), located externally with respect to the subsea machine 1. The cooling assembly may include connecting pipes (not shown) and at least one heat transfer element 6.

The subsea machine 1 and the cooling assembly 5 may be supported by a common supporting frame 7, which may be formed by a plurality of beams 7A, 7B, 7C mutually connected. The frame 7 may also comprise a basement B where the subsea machine 1 is stably fixed.

The cooling assembly 5 may comprise one or more heat transfer elements 6, mutually connected, and further connected to the connecting pipes (if present). At least a part of the heat transfer element 6 is integrated (i.e. forms a part) of the frame 7.

At least a part of the heat transfer element 6, may be a structural part of the supporting frame 7.

As shown in FIG. 1 a single heat transfer element 6 may be present, which completely surrounds the subsea machine 1.

In this configuration, the heat transfer element 6 may be winded in a spiral-like shape around the subsea machine, and the frame 7 may have a quadrangular shape, in an embodiment square shape, so that the heat transfer element is winded on the four sides of the quadrangle.

In the configuration shown in FIG. 1, the heat transfer element 6 forms a structural part of the supporting frame 7.

In this configuration, the heat transfer element may be a pipe realized in stainless steel or duplex, having a diameter comprised between 20 mm and 150 mm, in an embodiment 80 mm.

The thickness of the heat transfer element may be comprised between 3 mm and 20 mm, in an embodiment 8 mm. The distance between two parts of the heat transfer element 6 is designed based on the number and size of pipes, in order to improve the heat transfer rate of it.

The heat transfer element 6 may be formed by a single pipe properly shaped, or by a plurality of parts mutually joined (for example welded together). The different pipes of the heat transfer element 6 may be placed in series or in parallel (see FIGS. 4 and 5), and may be completely or only partially integrated in the frame 7. Pipes may have a smooth outer surface or may have protrusions, in order to maximize the heat exchange. For example, bumps or fins may be located on the pipes.

Figure 2:
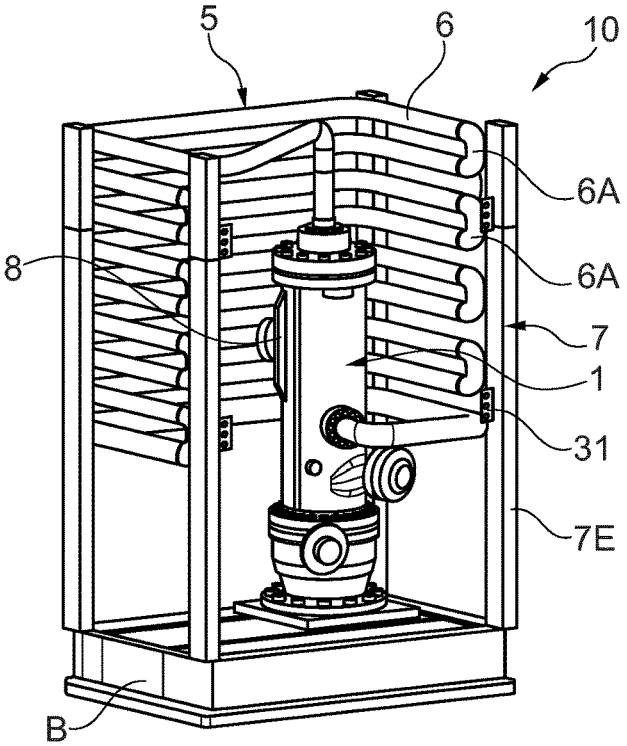
FIG. 2 is a simplified perspective view of an alternative to the subsea assembly of FIG. 1.

FIG. 2. shows an alternative to the embodiment of FIG. 1; here the cooling assembly 5 comprises a heat transfer element 6, that only partially surrounds the subsea machine 1. At least one side of the frame 7 is free from the heat transfer element 6. This allows an easier and direct access to the subsea machine 10 (for example in case of maintenance). In this configuration, the heat transfer element may have U-shaped parts 6A, placed at that side of the frame 7 free from the heat transfer element 6.

In particular, the frame 7 have a basement B connected to vertical beams 7E. The vertical beams 7E are mutually connected and kept in position also through the different parts of the heat transfer element 6, for example by welding or other removable fixing elements (screws, flanges etc.).

The U-shaped parts 6A may be connected with those vertical beams 7E placed at that side of the frame 7 free form the heat transfer element 6. As before, welding or removable fixing elements (screws, flanges etc.) may be used.

It should be noted that also the frame of FIG. 1, may comprise a basement with only four vertical beams connected to a heat transfer element having a shape as the one described in FIG. 1.

Figure 4:
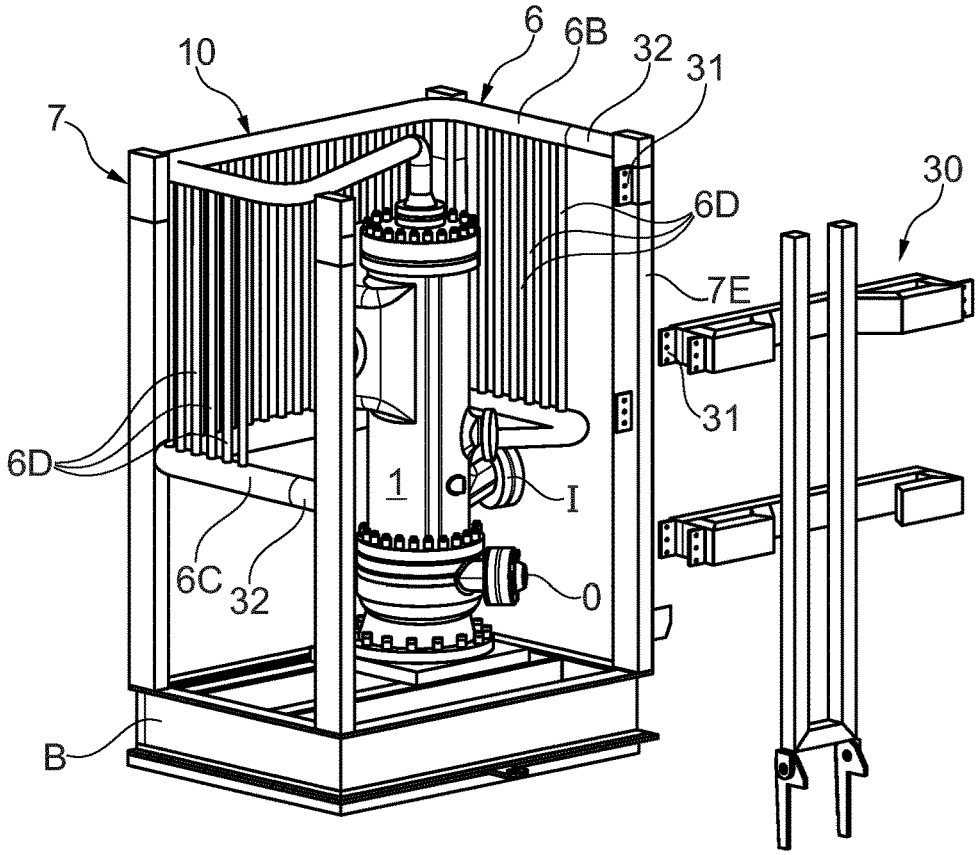
FIG. 4 is a perspective, partially exploded view, of an alternative embodiment of the subsea assembly of the present disclosure.
Figure 5:
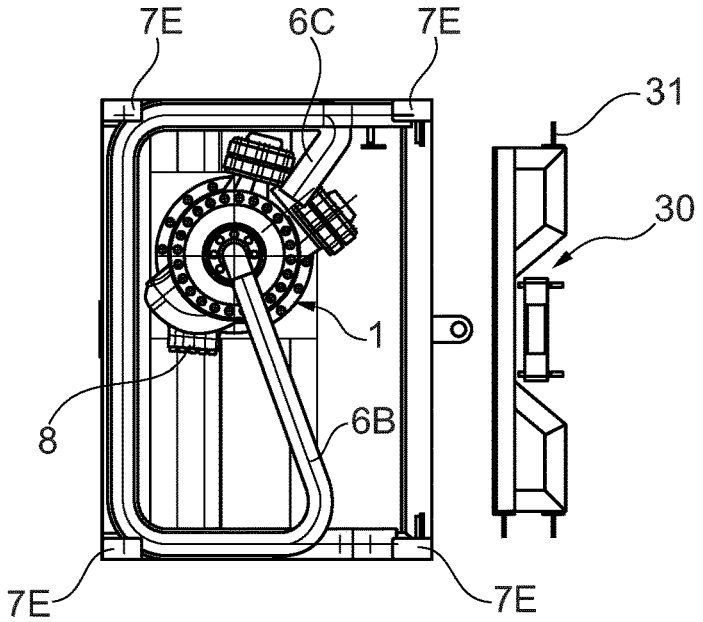
FIG. 5 is a plan view of the subsea assembly of FIG. 4.

FIG. 4 and FIG. 5 show an alternative embodiment of the subsea assembly of the present disclosure.

Here the heat transfer element 6 has a parallel configuration. It comprises a first main pipe 6B and a second main pipe 6C. A series of secondary pipes 6D are connected to the first main pipe 6B and second main pipe 6C with a parallel configuration. The first main pipe 6A and second main pipe 6B, that may have an external diameter that is bigger if compared to the external diameter of the secondary pipes 6D, are structural part of the frame 7. The secondary pipes 6D may be supported by the first main pipe 6B and the second main pipe 6C.

In this configuration, the frame 7 comprises vertical beams 7E connected with the basement B and with the first main pipe 6B and second main pipe 6C of the heat transfer element 6. The vertical beams 7E may be welded to the first 6C and second main pipe 6C, or removable fixing elements (screws, flanges etc.) may be used.

Between the heat transfer element 6 and the frame 7, distancing elements 32, which may also have a structural function, may be placed. In particular, the distancing elements 32 may be used to connect to the first main pipe 6B and the second main pipe 6C to the vertical beams 7E.

The first main pipe 6B and the second main pipe 6C may have a C-shape, so that the cooling assembly 5 may at least partially surround the subsea machine 1.

The subsea assembly of FIG. 2, FIG. 4 and FIG. 5, may comprise a removable wall that may also have a structural function for the frame 7, and may be part of it. It may be fixed to the vertical beams 7E by means of flanges 31 located on the vertical beams 7E and screws.

The description also relates to a subsea assembly supporting frame 7, having a basement B configured to support a subsea machine 1 and at least a heat transfer element 6 integrated in the frame 7.

The description further relates to a cooling assembly 5 comprising at least one heat transfer element 6 configured to be coupled to a subsea assembly supporting frame 7, where the heat transfer element have a structural function for the frame 7.

Of course, the heat transfer element may have all or part of the features, taken alone or in combination, described in the above description and represented in the figures. In particular, the heat transfer element 6 may have a structural function for the frame 7.

More in detail, in the configurations shown in FIG. 2 and FIG. 4, it may be also used to lift the entire frame.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What we claim is:

1. A subsea assembly comprising:

a quadrilateral base defining a planar surface having four corners;

a supporting frame comprising at least four vertical beams including a respective beam extending a length vertically from each of the four corners of the planar surface;

an electric subsea machine having an electric motor driving an operator, the subsea machine supported by the base and extending vertically from the planar surface in which an upper portion of the subsea machine extends vertically beyond the respective lengths of the at least four vertical beams; and a coolant circuit in thermal contact with the electric motor, the coolant circuit further comprising a cooling assembly located externally from the subsea machine, the cooling assembly comprising a continuous heat transfer element connected to and extending outward from the electric subsea machine, wherein the continuous heat transfer element is affixed to the at least four vertical beams and winds upward from the at least four vertical beams and completely around the upper portion of the subsea machine in a quadrangular spiral, the quadrangular spiral comprising a plurality of concentric windings shape.

2. The subsea assembly according to claim 1, wherein the coolant circuit is in thermal contact with a coil of the motor and/or with a junction box of the subsea machine.

3. The subsea assembly according to claim 2, wherein the coolant circuit is in thermal contact with at least a bearing of the subsea machine.

4. The subsea assembly according to claim 3, wherein the coolant circuit comprises a coolant pump torsionally fixed to a shaft of the electric motor.

5. The subsea assembly according to claim 1, wherein a single casing houses both the electric motor and the operator.

* * * * *